US011282430B2

(12) United States Patent
Ishii et al.

(10) Patent No.: US 11,282,430 B2
(45) Date of Patent: Mar. 22, 2022

(54) IMAGE DISPLAY SYSTEM

(71) Applicant: IGNITE, Inc., Tokyo (JP)

(72) Inventors: Fusao Ishii, Pittsburgh, PA (US); Victor Stone, Pittsbugn, PA (US); Toshitaka Torikai, Sagamihara (JP)

(73) Assignee: IGNITE, Inc., Tokyo (JP)

( * ) Notice: Subject to any disclaimer, the term of this patent is extended or adjusted under 35 U.S.C. 154(b) by 0 days.

(21) Appl. No.: 17/257,505

(22) PCT Filed: Jul. 2, 2019

(86) PCT No.: PCT/US2019/040348

§ 371 (c)(1),
(2) Date: Dec. 31, 2020

(87) PCT Pub. No.: WO2020/010112

PCT Pub. Date: Jan. 9, 2020

(65) Prior Publication Data

US 2021/0375177 A1 Dec. 2, 2021

Related U.S. Application Data

(60) Provisional application No. 62/694,011, filed on Jul. 4, 2018.

(51) Int. Cl.
*G09G 3/20* (2006.01)

(52) U.S. Cl.
CPC ..... *G09G 3/20* (2013.01); *G09G 2300/0842* (2013.01); *G09G 2310/08* (2013.01); *G09G 2360/12* (2013.01)

(58) Field of Classification Search
CPC ..... G09G 3/2033; G09G 3/2037; G09G 3/204
See application file for complete search history.

(56) References Cited

U.S. PATENT DOCUMENTS

2007/0126759 A1* 6/2007 Hwang ..... G09G 3/2033 345/691
2010/0073270 A1* 3/2010 Ishii ..... G09G 3/2037 345/84
2014/0092105 A1 4/2014 Guttag et al.
2017/0195596 A1 7/2017 Vogelsang et al.
2018/0114477 A1* 4/2018 Ishii ..... G09G 5/06

* cited by examiner

*Primary Examiner* — Sepehr Azari
(74) *Attorney, Agent, or Firm* — Young Basile Hanlon & MacFarlane, P.C.

(57) ABSTRACT

An image display system includes an array of pixel elements, column drivers, row drivers, a look up table memory, and a controller. Input video data including gradation information of an input image is received. According to rules of a look up table, the input video data is assigned to multiple groups, binary signals for respective groups are generated using the respective input video data assigned to each group, and an order of the binary signals within at least some groups is rearranged to form respective binary control signals without conflicting state changes. The controller transmits the binary control signals to the column drivers and transmits a select signal that selects the row drivers. Alternatively, the controller transmits the binary control signals to the row drivers and transmits a select signal that selects the column drivers. The select and binary control signals are in synchronization with a clock signal.

17 Claims, 9 Drawing Sheets

TABLE 1

TABLE 2

IMAGE DISPLAY SYSTEM

CROSS-REFERENCE TO RELATED APPLICATION

This application claims priority to and the benefit of U.S. Provisional Application Patent Ser. No. 62/694,011, filed Jul. 4, 2018, the entire disclosure of which is hereby incorporated by reference.

TECHNICAL FIELD

This disclosure relates to display device includes control circuit to receive digital image signals and applies the digital image signals to control the image display. More particularly, this disclosure relates to signal control methods for controlling the non-sequential order and timing of inputting state signals.

BACKGROUND

When display images are digitally controlled, the image qualities are adversely affected due to the fact that an image is not displayed with a sufficient number of half tones. A higher input data rate is required in order to increase the number of half tones.

However, in order to realize a higher input data rate in a high-resolution system, the number of integrated circuit (IC) connection pads will increase.

SUMMARY

Hardware structures comprising display devices and control circuits using digital image data processing methods are proposed in U.S. Pat. No. 8,228,595 B2. The present disclosure describes how to display digital image data using binary digital pulse width modulation to control half tones (also referred to as gradations or gray scale levels) with a reduced number of IC connection pads.

An image display system includes a plurality of pixel elements arranged in an array, a plurality of column drivers, each respectively electrically coupled to a column of the array, a plurality of row drivers, each respectively electrically coupled to a row of the array, a look up table memory that stores at least one look up table, each look up table including rules for converting the input video data into control signals, and a controller. The controller receives input video data composed of gradation information of an input image comprising multiple rows and multiple columns of a frame and, in accordance with the rules for a look up table, assigns the input video data to multiple groups, generates binary signals for respective groups of the multiple groups using the respective input video data assigned to each group, and rearranges an order of the binary signals within at least some of the multiple groups to form respective binary control signals wherein state changes of the binary control signals of the multiple groups do not conflict with each other. The controller transmits the binary control signals to the plurality of column drivers to control a state of a column of pixel elements of the array and transmits a select signal that selects the plurality of row drivers to select the row of pixel elements of the array to receive the binary control signals. Alternatively, the controller transmits the binary control signals to the plurality of row drivers to control a state of a row of pixel elements of the array and transmits a select signal that selects the plurality of column drivers to select the column of pixel elements of the array to receive the binary control signals. The select signal and the binary control signals are in synchronization with a clock signal of the controller.

An image display method includes receiving input video data composed of gradation information of an input image comprising multiple rows and multiple columns of a frame, accessing a look up table memory that stores at least one look up table, each look up table including rules for converting the input video data into control signals, and in accordance with the rules for a look up table, assigning the input video data to multiple groups, generating binary signals for respective groups of the multiple groups using the respective input video data assigned to each group, and rearranging an order of the binary signals within at least some of the multiple groups to form respective binary control signals wherein state changes of the binary control signals of the multiple groups do not conflict with each other. The method also includes one of transmitting the binary control signals to a plurality of column drivers to control a state of a column of pixel elements of an array and transmitting a select signal that selects a plurality of row drivers to select a row of pixel elements of the array to receive the binary control signals, or transmitting the binary control signals to the plurality of row drivers to control a state of the row of pixel elements of the array and transmitting a select signal that selects the plurality of column drivers to select a column of pixel elements of the array to receive the binary control signals. The select signal and the binary control signals are in synchronization with a clock signal of a controller, the plurality of column drivers is each respectively electrically coupled to a column of the array, and the plurality of row drivers is each respectively electrically coupled to a row of the array.

Details of these implementations, and variations in these and other implementations of the teachings herein are described in detail below.

BRIEF DESCRIPTION OF THE DRAWINGS

The disclosure is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity. Further, like reference numbers refer to like elements unless otherwise noted.

DETAILED DESCRIPTION

Figure 1:
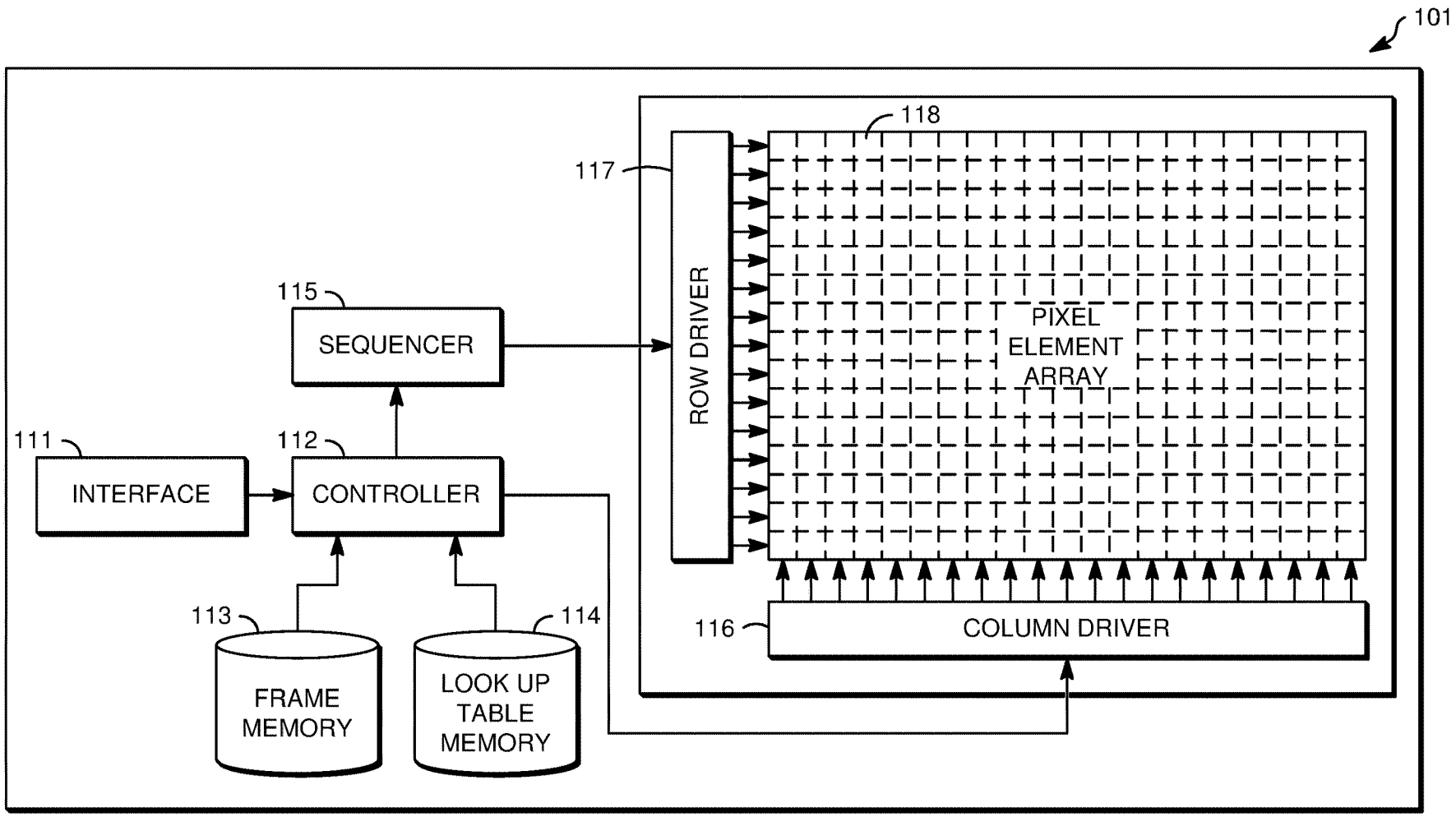
FIG. 1 is a block diagram showing a configuration of an image display system.

FIG. 1 is a block diagram showing a configuration of an image display system 101. The image display system includes an interface 111, a controller 112, a frame memory 113, a look up table memory 114, a sequencer 115, a plurality of column drivers 116, a plurality of row drivers 117, and a pixel element array 118.

The pixel element array 118 can vary with the image display system 101. For example, if the image display system 101 is a high-definition television (HDTV) system, the array 118 has 1920 (horizontal)×1080 (vertical) pixel elements. Each pixel element consists of a device that emits light, e.g., plasma or organic light-emitting diode (OLED), reflects light, e.g., liquid crystal on silicon (LCOS) or a micromirror, or modulates light, e.g., a liquid crystal display (LCD), to create images. In one example of operation, the column drivers 116 send control signals to pixel elements in a row selected by the row drivers 117. The signals sent by the column drivers 116 will be transferred to pixel elements in the row. The system 101 selects only one row at a time assuming there is no duplicated image in the display.

The controller 112 in FIG. 1 controls which row should be chosen through the sequencer 115 (e.g., through sequential selection) and transfer signals to the pixel elements in the row through the column drivers 116. The pixel elements that receive the signals will emit light, reflect light, or modulate light according to the signals and the type of device that forms the pixel element. Because the incoming signals to the interface 111 are sequential from top row to bottom row (see FIG. 6A), the controller 112 also sends signals from top row to bottom row. The incoming data often include three colors in parallel as high-definition multimedia interface (HDMI) or video graphics array (VGA) signals. Depending on the type of display, the pixel element array 118 may require three colors in parallel or each color sequentially. If the display is a color sequential display, the pixel element array 118 requires each color sequentially. Herein, the terms "data" and "signal" are used interchangeably.

The interface 111 may be any type of wired or wireless connection that allows the transfer of signals from external of the controller 112 to the controller 112. These signals may be referred to an input video data herein, and the signals comprise or are composed of gradation information of an input image comprising multiple rows and multiple columns of a frame, The interface 111 may be incorporated with the controller 112, or may be a separate device that communicates with an input of the controller 112. One possible device that may be used for the interface 111 is the Sil9187B HDMI port processor from Silicon Image, Inc., of Sunnyvale, Calif.

The timing of incoming data and the timing of writing signals into pixel elements often do not match. It is desirable for the frame memory 113 to (e.g., temporarily) store the incoming data to adjust timing and/or sequence of signals between the incoming data and the display device. In addition, the image display system 101 uses a memory that stores the sequence of rows and the orders of data bits to write signals into pixel elements. This memory is referred to as look up table (LUT) memory 114 as shown in FIG. 1. The sequence of row and data bits may be stored in the LUT memory 114.

Figure 2:
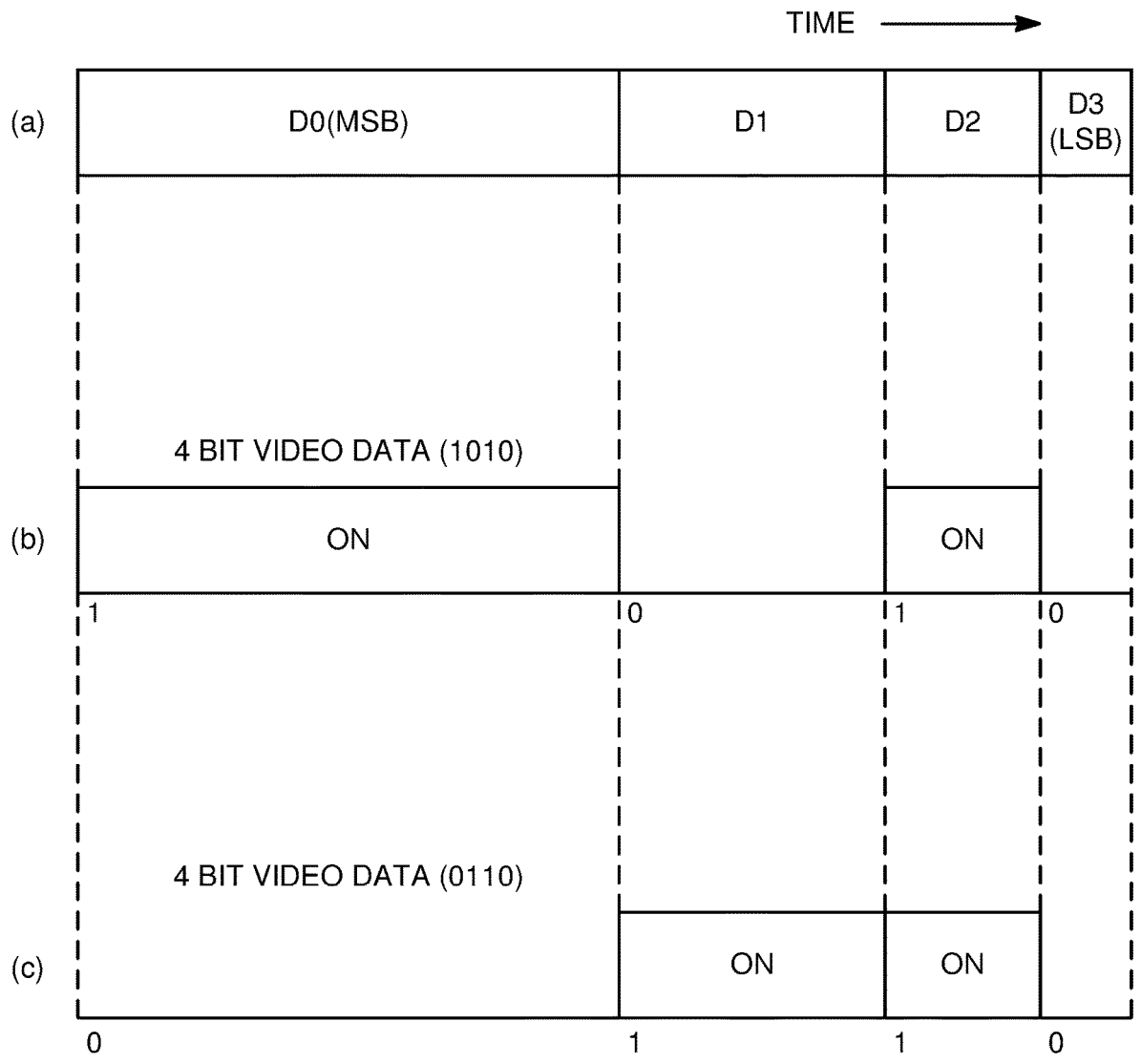
FIG. 2 is a diagram for explaining the structure of a signal that expresses 16 gradations with 4 bits input to a single pixel element.

FIG. 2 is a diagram for explaining the structure of video data representing 16 gradations with 4 bits input to one pixel element. The row (a) included in FIG. 2 is a diagram showing the temporal change of the 4-bit data string, and the horizontal axis shows passage of time. Also, bits D0, D1, D2, and D3 are allocated from the left. D0 is the most significant bit (MSB), and D3 is the least significant bit (LSB). One pixel element is the time corresponding to the elapsed time of the bit when the signal is input, and light is emitted, reflected, or modulated. The time of D1 is half the time of D0 (MSB), the time of D2 is half of the time of D1, and the time of D3 (LSB) is half of the time of D2. Video data is controlled synchronously with the system clock signal (e.g., from the controller 112. The length of D3 (LSB) is determined by a predetermined number of clocks, which is defined as one unit (1 U). The total time of D0 to D3 (LSB) is 1 U+2 U+4 U+8 U=15 U, which is 15 times longer than the time of D3 (LSB). By doing this, and properly selecting bits from D0 to D3, it is possible to create 16 half tones. For example, when D0 is 1, the state is held for the time corresponding to 8 U of the clock signal, and similarly when D2 is 1, the state corresponding to 2 U of the clock signal is held.

The line (b) included in FIG. 2 shows an example of video data that represents 1010 in 4-bit binary code. A pixel element is turned ON for the time corresponding to D0 and D2. Therefore, the pixel element can display gradation levels of $^{10}/_{15}$. The line (c) included in FIG. 2 shows an example of video data that represents 0110 in 4-bit binary code. A pixel element is turned ON for the time corresponding to D1 and D2. Therefore, the pixel element can display a gray scale level of $^{6}/_{15}$.

Figure 3:
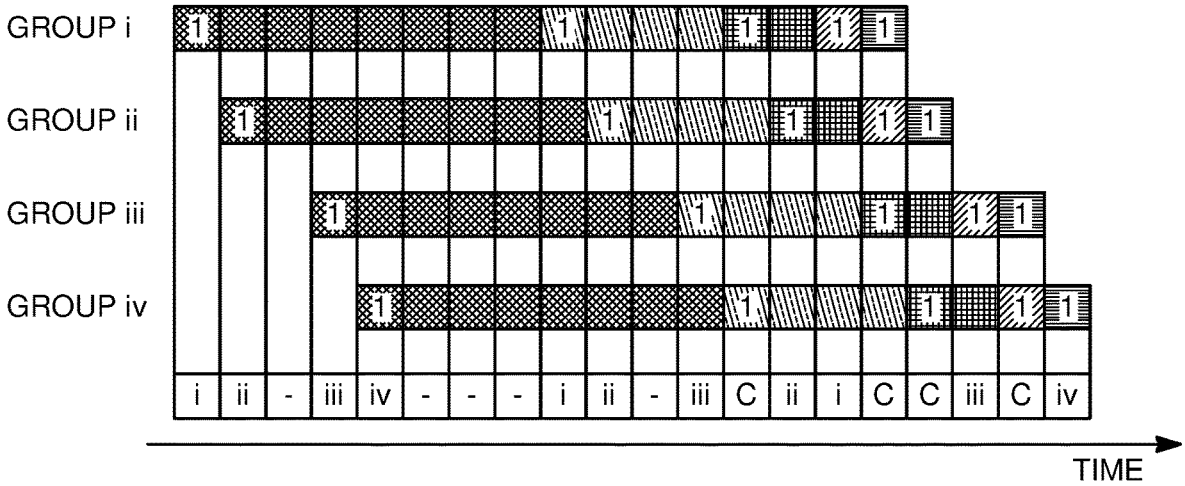
FIG. 3 is an example of invalid blocks and group combinations where there are occurrences of more than 1 block write in a unit time.

FIG. 3 shows an example of an invalid group of 4-bit video data. The group of each video data is added to the bits from D0 to D3, and finally 1 is added as an end bit. The lowest row included in FIG. 3 is data for determining the group to be selected in synchronization with the clock signal. In order to avoid conflicts between each video data, start bits of each video data are shifted by 1 U unit and arranged. However, for example, D2 of Group i conflicts with D1 of Group iv. Also, the end bit of Group i conflicts with D3 of Group ii and D2 of Group iii. The end bit of Group ii conflicts with D2 of Group iv, and the end bit of Group iii conflicts with D3 of Group iv. Therefore, the video data of Groups i-iv cannot be transmitted with one signal line.

Figure 4:
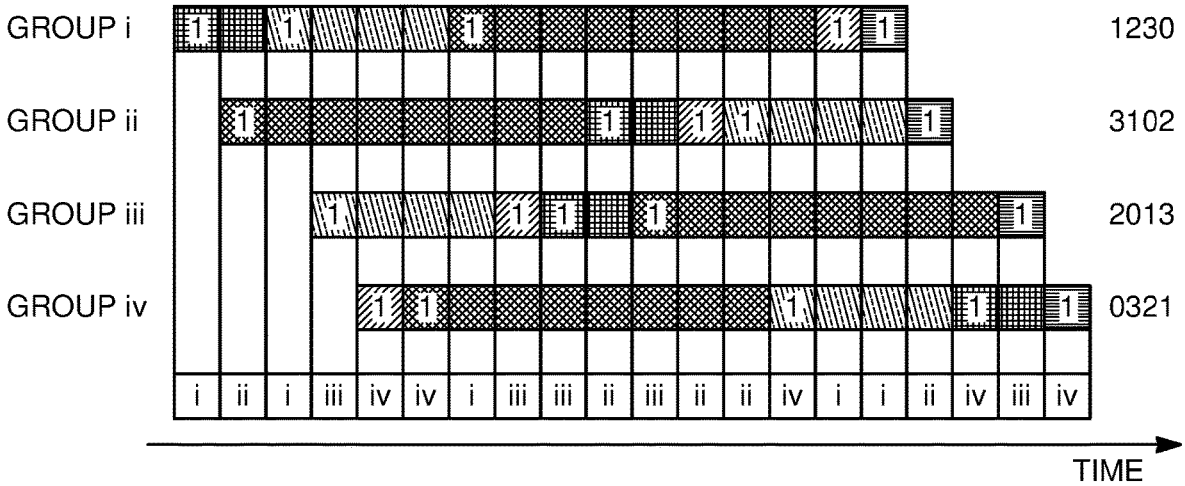
FIG. 4 is an example of valid group combinations using the groups of FIG. 3.

FIG. 4 shows an example of a valid group of 4-bit video data (also referred to as Table 1). FIG. 4 shows a valid group constructed by swapping the order of the bits of FIG. 3. Assuming that the arrangement order of the bits of Group i included in FIG. 3 is 3210, Group i included in FIG. 4 is rearranged in order of 1230. Similarly, Group ii is sorted to 3102, Group iii to 2013, and Group iv to 0321. By doing so, the video data of each Group can be converted into the video data in the order of 'i-ii-i-iii-iv-iv-i-iii-iii-ii-ii-iv-i-i-ii-iv-iii-iv'. Accordingly, each Group can transmit without conflict.

Figure 5:
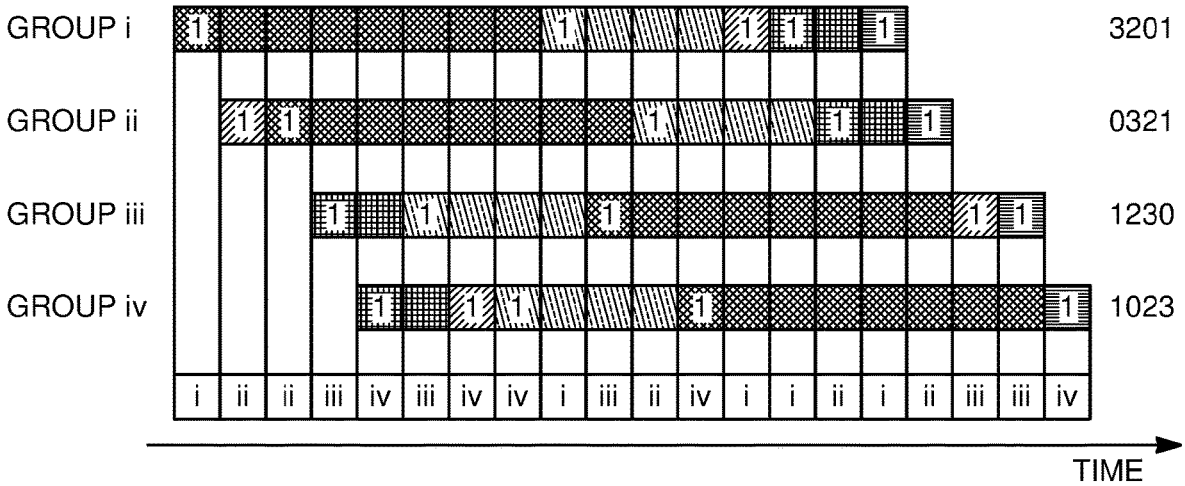
FIG. 5 is an example of valid group combinations using the groups of FIG. 3.

FIG. 5 shows another example of a valid group of 4-bit video data referred to as Table 2). FIG. 5 also shows a valid group composed by swapping the order of the bits in FIG. 3. Group i included in FIG. 4 is soiled in the order of 3201. Similarly, Group ii is sorted into 0321, Group iii into 1230, and Group iv into 1023. As a result, the video data of each Group can be expressed in order as 'i-ii-ii-iii-iv-iii-iv-iv-i-iii-ii-iv-i-i-ii-i-ii-iii-iii-iv'. Accordingly, each group can transmit without conflict.

In the case where video data is 4 bits, when Group i-iv is shifted by 5 U at maximum, there are two patterns of FIG. 4 and FIG. 5 in the valid group arrangement. Information of either or both of FIG. 4 and FIG. 5 is stored as a LUT in the LUT memory 114.

Figure 6A:
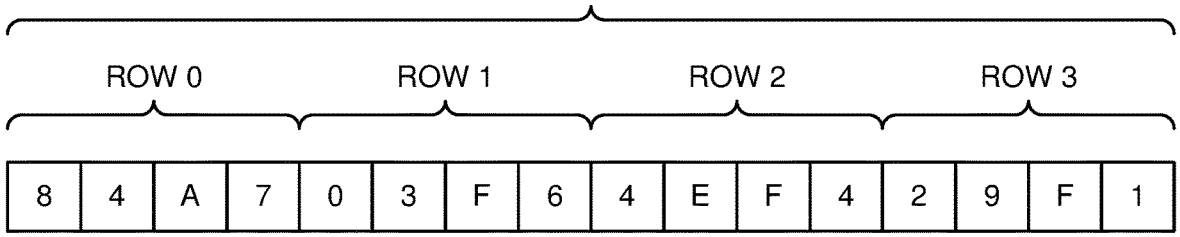
FIG. 6A is a diagram showing an arrangement of input video data.

FIG. 6A shows one frame of incoming data to the interface 111 is sequential from top row to bottom row. The incoming data shows the gradation of each pixel element written in hexadecimal.

Figure 6B:
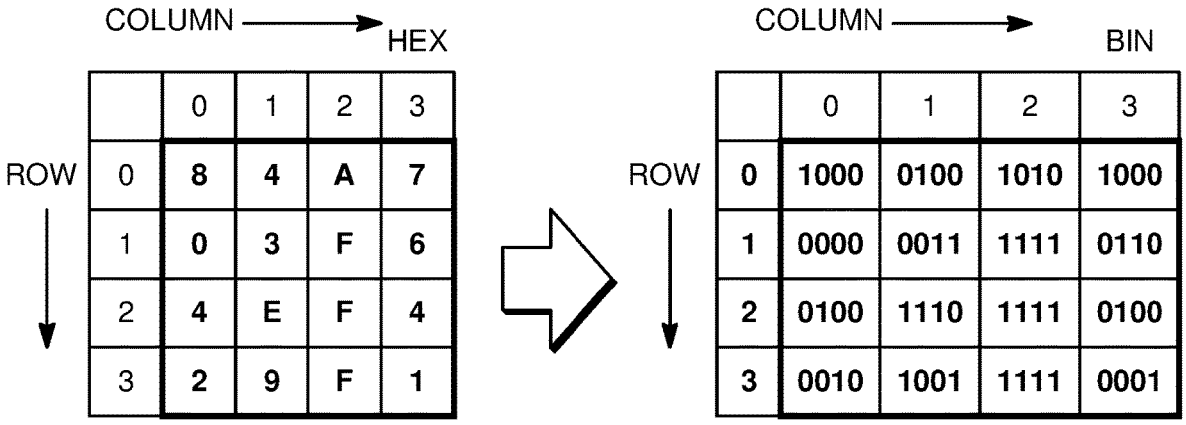
FIG. 6B is a diagram showing a matrix of video data.

FIG. 6B shows a state where the incoming data of FIG. 6A is stored in the frame memory 113 by the controller 112. To the left in FIG. 6B is an image of the data in the frame memory 113 arranged in a matrix corresponding to columns and rows of the pixel element array 118. The data in the image to the right in FIG. 6B is shown in binary notation.

Figure 7:
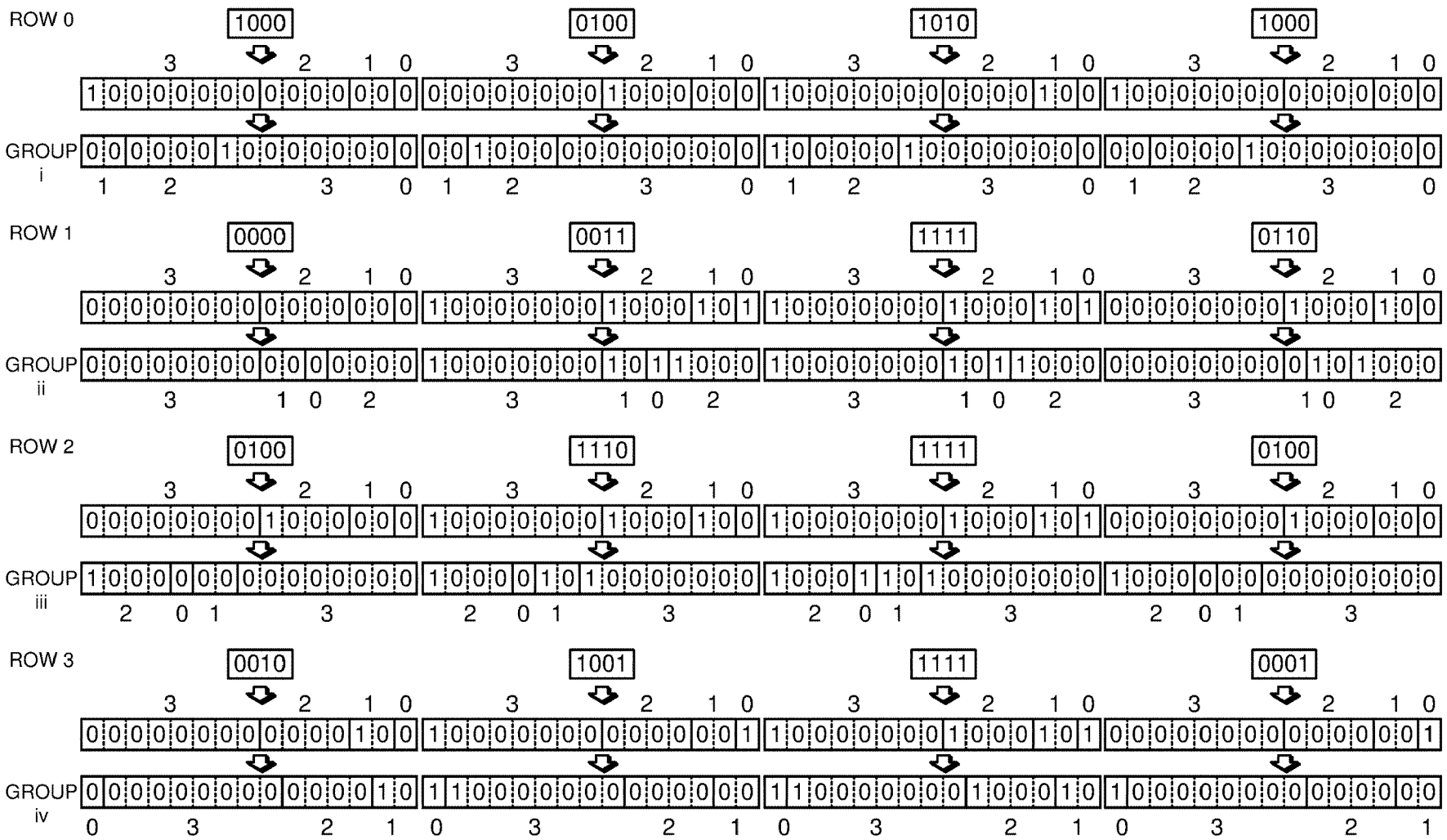
FIG. 7 is a conceptual diagram for converting data inside the matrix shown in FIG. 6B.

FIG. 7 is an image diagram for converting the data inside the matrix shown in FIG. 6B. Data conversion is performed by swapping the order of bits according to the valid group shown in FIG. 4, which is stored in a LUT in LUT memory 114. For example, data 1010 of column 2, row 0 is expanded to control signals of '10000000, 0000, 10, 0' according to FIG. 2. That is, so the signal indicates to hold the pixel element ON (and hence emitting, reflecting, or modulating light) for a time corresponding to 8 U of the clock signal because D0 is 1, OFF (not emitting, reflecting, or modulating light) for a time corresponding to 4 U of the clock signal because D1 is 0, ON for a time corresponding to 2 U of the clock signal because D2 is 1, and OFF for a time corresponding to 1 U of the clock signal because D3 is 0. The expanded control signal (e.g., corresponding to order 3210 described with regards to FIG. 3) is converted or rearranged to control signal '10, 0000, 10000000, 0' according to the LUT (e.g., corresponding to order 1230 described with regards to FIG. 4). The converted control signal is transmitted to the column driver 116. Expansion and conversion of each data are performed in the same manner, as is shown in detail in FIG. 7. In this case, the conversion rule of Group i is assigned to row 0 of the matrix, the conversion rule of Group ii is assigned to row 1 of the matrix, the conversion rule of Group iii is assigned to row 2 of the matrix, and the conversion rule of Group iv is assigned to row 3 of the matrix. Assignment of conversion rules may be replaced as appropriate.

Stated more generally, a LUT stored in LUT memory 114 comprises one or more rules for converting incoming data (e.g., from the interface 111) to control signals for use in driving the light devices of a pixel element array, such as the pixel element array 118. The rules describe expanding incoming data to an expanded signal. By expanding the incoming data or signal, this disclosure refers to the process of converting the incoming data (e.g., originally in hexadecimal or binary format) to a control signal (i.e., an expanded signal) that corresponds to a defined duration of clock cycles for which to hold the state of each bit of the incoming data. This may also be referred to as synchronizing the incoming data to the clock of the controller 112. As described in FIG. 2, for example, the state of each bit of the incoming data (in binary format) is assigned a number of clocks or clock units U to hold. These may be thought of as write signals for one or more pixel elements of an array so that the pixel elements display a gradient responsive to the incoming data. The rules for converting the incoming data describe converting or rearranging the resulting expanded signal to defined order, which is shown by example in FIG. 7. The defined order is such that, when combined with the rearranged, expanded signals for other pixel elements of the array, the resulting sequence provides a single control signal that allows the control of multiple pixels in a row and column, as shown by example in FIG. 8 below, without conflicts in signaling a new state for a pixel. The LUT may also include rules to define the Groups. The LUT may define the each of the rules based on the number of gradients indicated in the incoming data, the size of an incoming signal on a per pixel basis, the number of clock cycles for an incoming signal, a length of the expanded signals, a size of the array, etc., or any combination of these features.

Figure 8:
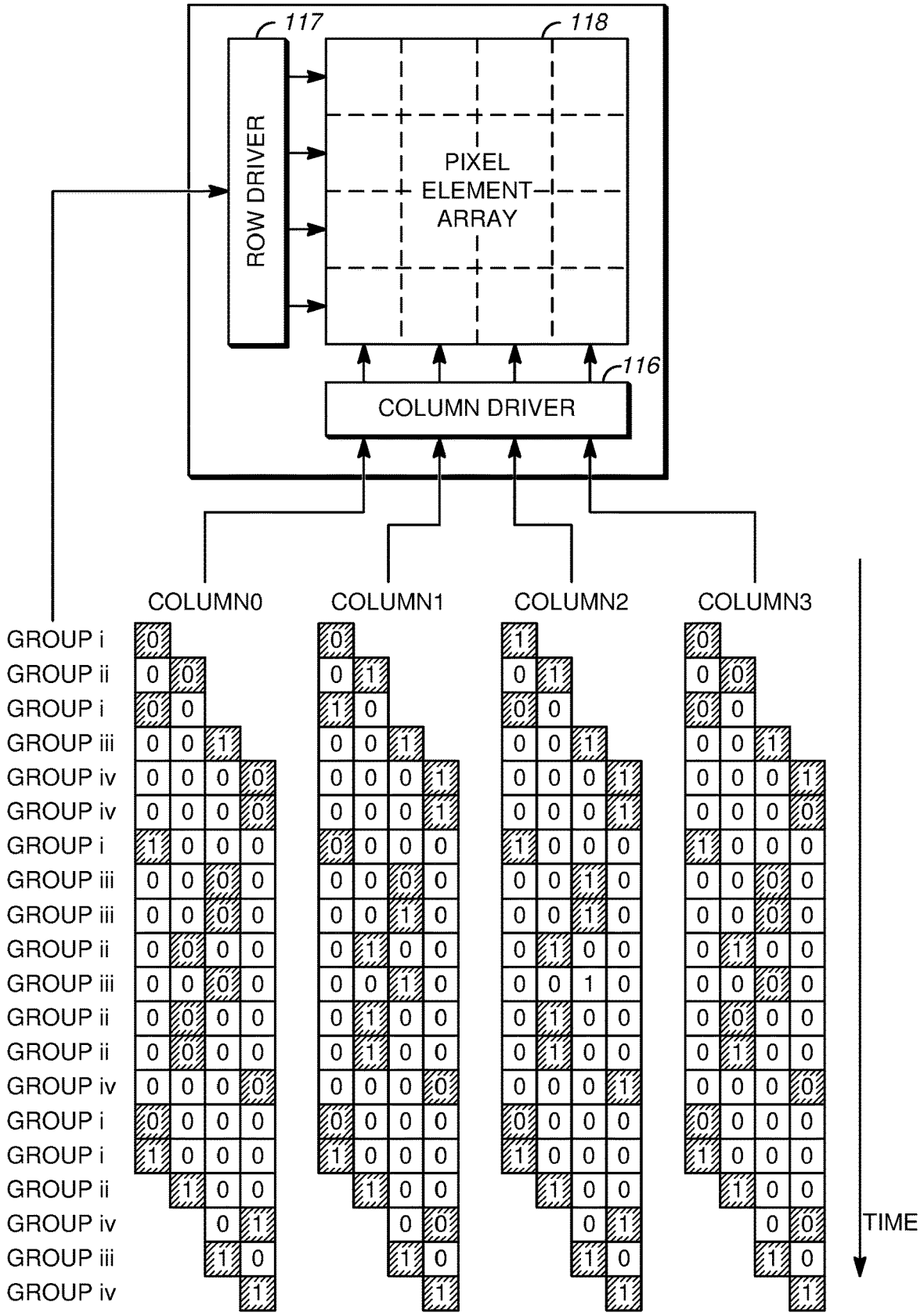
FIG. 8 is a diagram showing bit data to be transmitted to the column driver and a column selection signal to be transmitted to the row driver.

FIG. 8 is an image diagram showing the order of transmitting the converted control signals shown in FIG. 7 to the pixel element array 118. For simplicity of explanation, FIG. 8 uses a display system consisting of 16 pixel elements arranged in a 4×4 matrix. The control signals of each row are ended with an end bit. The sequence signals are sequentially transmitted to the column driver 116 in synchronization with the clock signal. The transmitted signal is the hatched part of FIG. 8. For example, the control signal transmitted to column 1 is '0-1-1-1-1-1-0-0-1-1-1-1-1-0-0-1-1-0-1-1'. Also, to sequencer 115, a row select signal for selecting the row is transmitted from the controller 112 according to the LUT. In this case, the row select signal of the sequencer 115 is synchronized with the clock signal in order of 'i-ii-i-iii-iv-iv-i-iii-iii-ii-iii-ii-ii-iv-i-i-ii-iv-iii-iv'. The sequencer 115 selects the row driver 117 according to the row select signal. Therefore, for example, in column 1, the control signal '0' transmitted first is transmitted to the pixel element of column 1, row 0. Next transmitted control signal '1' is sent to the pixel element of column 1, row 1. Furthermore, control signal '1' to be transmitted next is sent to the pixel element of column 1, row 0. That is, in the pixel element of column 1, row 0, '0' is held for the time of 2 U (corresponding to an OFF state), and '1' is input after that (corresponding to an ON state). In other words, the sequencer 115 sequentially selects the plurality of row drivers (or column drivers in an alternative arrangement). The sequencer 115 may be, for example, a complementary metal-oxide semiconductor (CMOS) logic circuit that provides the sequence of addresses for the row and column drivers.

As described above, by transmitting control signals, control signals of each row can be superimposed and transmitted to each column driver 116.

Although the display system consisting of 16 pixel elements of a 4×4 matrix has been described above, a higher resolution display system may be used. This system can also be used with Full high definition (HD) of 1920×1080 or 4K display system of 3840×2160, for example. In that case, because a column is 1920 or 3840 pixel elements, a demultiplexer (Demux) may be placed between controller 112 and the column driver 116. Because a row becomes 1080 or 2160 pixel elements, when the control signal is divided into 4 groups, control can be performed using 270 blocks or 540 blocks, respectively. Also, although the video data has been described as 4-bit data, in order to further enhance the gradation brightness, 8-bit or 10-bit data may be used. In that case, there are more combinations of valid solutions than two. For 10-bit data, a valid solutions of 70 divisions exist. Therefore, it is possible to control 1080 rows with 16 groups.

According to the above system, it is possible to realize a display system of high resolution in gray scale without complicating the structure of wirings and the like.

The controller 112 may select a look up table to be used for each frame from a plurality of LUTs stored in the LUT memory 114. For example, by switching between Table 1 and Table 2 on a frame-by-frame basis, the pattern of a line sequence displaying video data corresponding to a row will change frame to frame. The viewer will recognize fewer artifacts using the non-sequential line drive. That is, for example, if lines are divided into some blocks as Group1=1-100, Group2=101-200, etc., irregularity may be seen between the 100th and 101st lines. This is an artifact that may be obscured by the teachings herein if the border between blocks changes every frame. The controller may select look up tables to be used from a plurality of look up tables in a predetermined order. The controller may randomly select the look up table to use from multiple look up tables.

Figure 9:
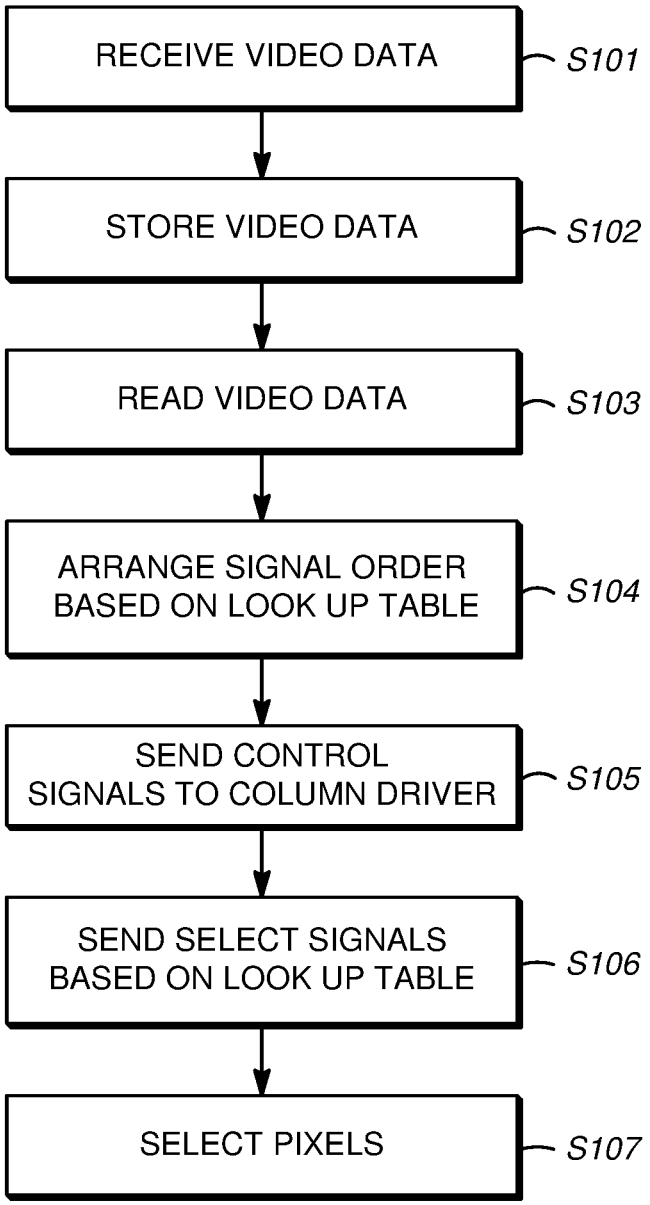
FIG. 9 is a flowchart showing a display process of an image display system.

Next, the display process of the image display system 101 will be described with reference to FIG. 9. FIG. 9 is a flowchart of the data and signal processing steps of the controller 112. The controller 112 can be realized in hardware, software, or any combination thereof. The hardware can include computers, application-specific integrated circuits (ASICs), programmable logic arrays, optical processors, programmable logic controllers, microcode, microcontrollers, servers, microprocessors, digital signal processors, or any other suitable circuit. The controller 112 can encompass any of the foregoing hardware, either singly or in combination. The controller 112 can be implemented using a general-purpose computer or general-purpose processor with a computer program that, when executed, carries out any of the respective methods, algorithms and/or instructions described herein. A special purpose computer/processor can be utilized that contains other hardware for carrying out any of the methods, algorithms, or instructions described herein.

In step S101, the controller 112 receives video data such as HDMI received by the interface 111 from an external device.

In step S102, the controller 112 optionally stores the received video data in the frame memory 113.

In step S103, the controller 112 reads the video data stored frame memory 113 according to a LUT stored in the LUT memory 114. The LUT may be one of a plurality of LUTs stored ahead of time to define valid Groups as described above. LUTs may be stored according to the display resolution, the number of Groups, or other characteristics of the system 101.

Each of the frame memory 113 and the LUT memory 114 may comprise any type of hardware memory. For example, each can be a read-only memory (ROM) device, a random-access memory (RAM) device, other type of memory, or a combination thereof. Any other suitable type of storage device or non-transitory storage medium can be used. The frame memory 113 and the LUT memory 114 may be the same or different types of memory. One or both of the frame memory 113 and the LUT memory 114 may be integrated with the controller 112, instead of being implemented as separate devices. The frame memory 113 and the LUT memory 114 may be combined in a single memory storage device.

In step S104, the controller 112 arranges the data order according to the LUT, and generates a control signal.

In step S105, the controller 112 transmits a control signal to column driver 116.

In step S106, the controller 112, according to the LUT, transmits a row select signal to the sequencer 115.

In step S107, the pixel element array 118 displays the selected pixel element based on the control signal from the column driver 116 and the row select signal from the sequencer 115.

Figure 10A:
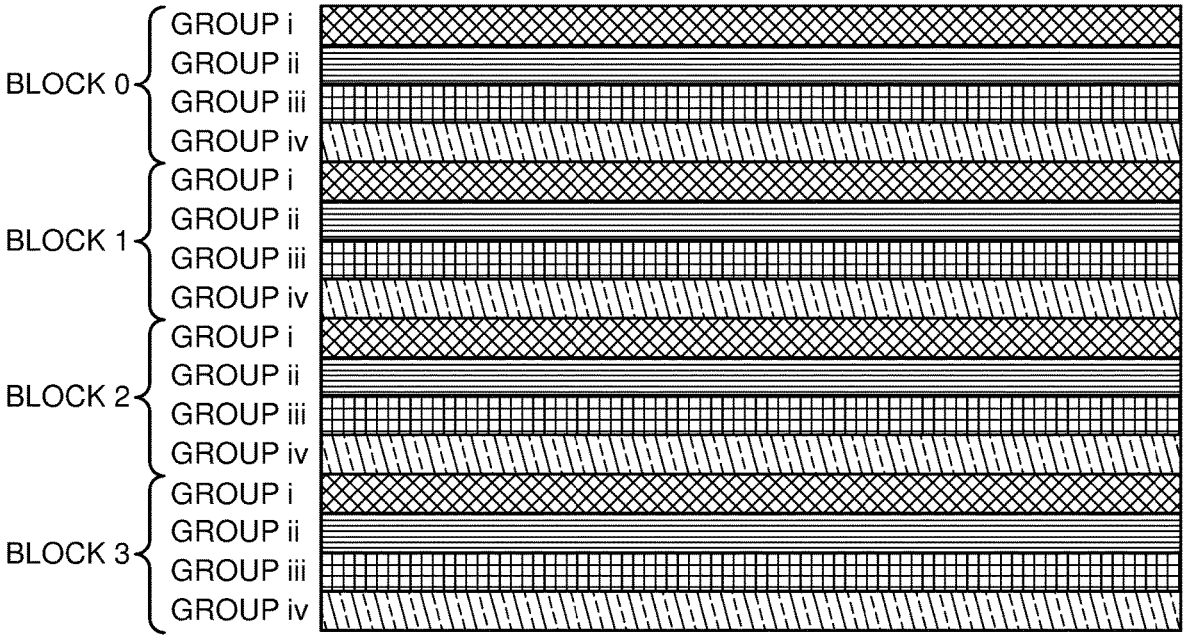
FIG. 10A is a conceptual diagram showing an example in which a row is divided into four blocks and displayed.
Figure 10B:
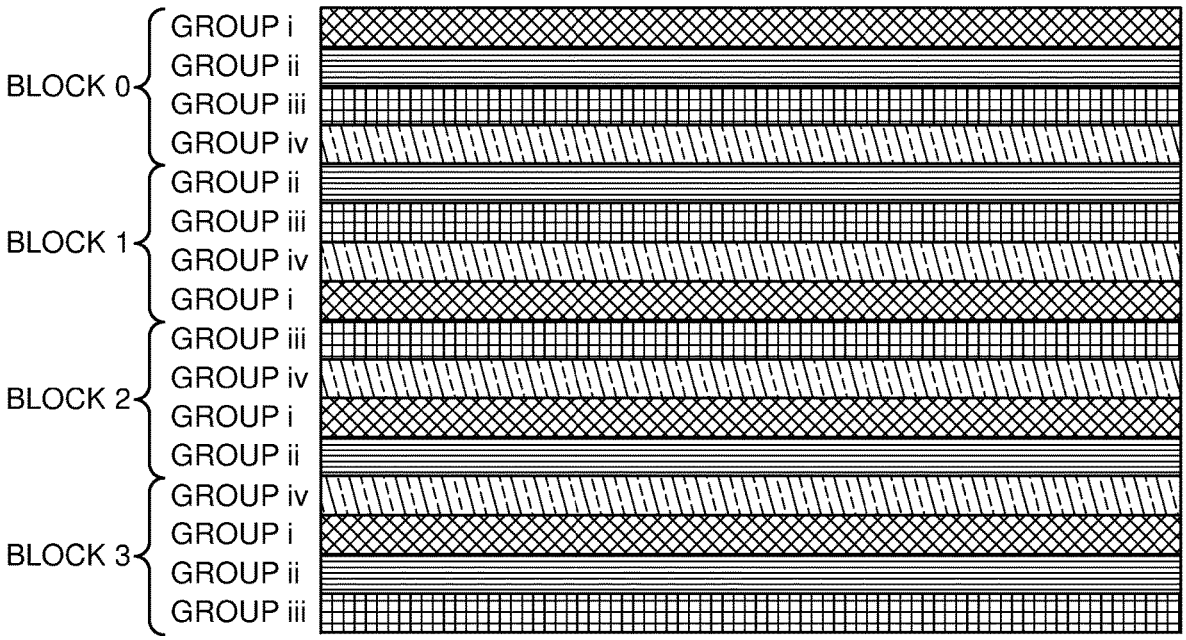
FIG. 10B is a conceptual diagram showing ample of displaying groups inside the four blocks of FIG. 10A by interleaving.
Figure 10C:
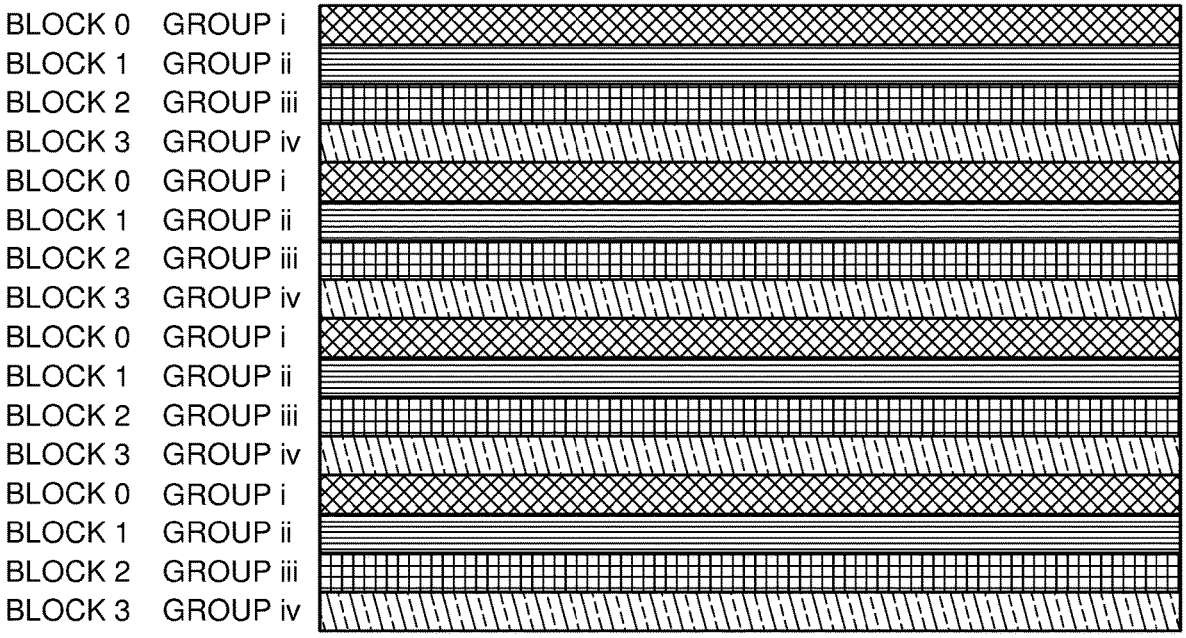
FIG. 10C is a conceptual diagram showing an example in which four blocks are dispersed and displayed by interleaving.

FIGS. 10A to 10C illustrate different assignments of multiple groups (such as the Groups i-iv in this example) to blocks in the situation where the input video data is divided into blocks. As can be seen below, assigning the multiple groups to the blocks may include assigning each of the multiple groups to a respective block in a random order or a predetermined order. The predetermined order can specify that each group of the multiple groups is assigned to a respective row of the multiple rows in a respective block in a same order for each block or a different order for each block.

In an example of FIG. 10A, a row is divided into four blocks and displayed. In this case, the Group in each block is displayed shifted by U units from Group i to Group iv. Therefore, there is a possibility that the viewer feels uncomfortable (e.g., recognizes a discontinuity) at the joint (e.g., borders) between the periodically occurring blocks.

FIG. 10B is a conceptual diagram showing an example of displaying Groups inside the four blocks using interleaving. In this case, the Group in each block is not in the order of Group i to Group iv. Therefore, for example, by switching between the display of FIG. 10A and the display of FIG. 10B, the viewer is less likely to feel uncomfortable at the joint between the periodically occurring blocks.

FIG. 10C is a conceptual diagram showing an example in which four blocks are dispersed and interleaved. In this case, different blocks are assigned to each row, and the borders between the blocks are finely dispersed. As a result, the viewer will perceive fewer borders between the periodically occurring blocks. In addition, switching between the display of FIG. 10A and the display of FIG. 10C will make the seams less noticeable.

In this way, the controller 112 divides the video data of the frame memory 113 into a plurality of blocks and assigns groups to each video data constituting each block according to the look up table. Also, the controller 112 may assign groups to each video data making up each block according to the look up table for each frame. Also, the controller 112 may assign groups to each video data making up each block in a predetermined order according to the look up table. Also, the controller 112 may allocate groups randomly, that is in a random order, to each video data making up each block according to the look up table.

Although the present invention has been described in terms of certain embodiments, it is to be understood that such disclosure is not to be interpreted as limiting. Various alterations and modifications will become apparent to those skilled in the art after reading the disclosure. Accordingly, it is intended that the appended claims be interpreted as covering all alternations and modifications that fall within the scope thereof.

What is claimed is:

1. An image display system, comprising:

a plurality of pixel elements arranged in an array;

a plurality of column drivers, each respectively electrically coupled to a column of the array;

a plurality of row drivers, each respectively electrically coupled to a row of the array;

a look up table memory that stores at least one look up table, each look up table including rules for converting input video data into control signals; and a controller that:

receives the input video data composed of gradation information of an input image comprising multiple rows and multiple columns of a frame;

in accordance with the rules for a look up table:

assigns the input video data to multiple groups;

generates binary signals for respective groups of the multiple groups using respective input video data assigned to each group; and rearranges an order of the binary signals within at least some of the multiple groups to form respective binary control signals wherein state changes of the binary control signals of the multiple groups do not conflict with each other;

one of:

transmits the binary control signals to the plurality of column drivers to control a state of a column of pixel elements of the array and transmits a select signal that selects the plurality of row drivers to select a row of pixel elements of the array to receive the binary control signals; or transmits the binary control signals to the plurality of row drivers to control a state of a row of pixel elements of the array and transmits a select signal that selects the plurality of column drivers to select the column of pixel elements of the array to receive the binary control signals, wherein:

the select signal and the binary control signals are in synchronization with a clock signal of the controller, the look up table memory stores multiple look up tables, and the controller selects the look up table from the multiple look up tables.

2. The system according to claim 1, wherein the controller randomly selects the look up table from the multiple look up tables.

3. The system according to claim 1, wherein the input video data is received on a frame-by-frame basis, and the controller selects a look up table to use for each frame from the multiple look up tables.

4. The system according to claim 1, wherein the controller selects look up tables to use from the multiple look up tables in a predetermined order.

5. The system according to claim 1, wherein the controller divides the input video data into a plurality of blocks, and assigns the multiple groups to the plurality of blocks.

6. The system according to claim 5, wherein the controller assigns the multiple groups to the plurality of blocks by assigning each of the multiple groups to respective blocks of the plurality of blocks in one of a random order or a predetermined order.

7. The system according to claim 6, wherein each block comprises multiple rows of the array, and the predetermined order specifies that each group of the multiple groups is assigned to a respective row of the multiple rows in a respective block in one of a same order or a different order.

8. The system according to claim 6, wherein the controller assigns the multiple groups to the plurality of blocks by interleaving rows of the plurality of blocks.

9. The system according to claim 1, wherein the select signal is a row select signal, the system further comprising a sequencer connected with the plurality of row driver and receiving the row select signal from the controller to sequentially select the plurality of row drivers.

10. The system according to claim 1, further comprising a frame memory for temporarily storing the input video data, wherein the controller receives the input video data from the frame memory.

11. An image display method, comprising:

receiving input video data composed of gradation information of an input image comprising multiple rows and multiple columns of a frame;

accessing a look up table memory that stores at least one look up table, each look up table including rules for converting the input video data into control signals;

in accordance with the rules for a look up table:

assigning the input video data to multiple groups;

generating binary signals for respective groups of the multiple groups using the respective input video data assigned to each group;

rearranging an order of the binary signals within at least some of the multiple groups to form respective binary control signals wherein state changes of the binary control signals of the multiple groups do not conflict with each other; and one of:

transmitting the binary control signals to a plurality of column drivers to control a state of a column of pixel elements of an array and transmitting a select signal that selects a plurality of row drivers to select a row of pixel elements of the array to receive the binary control signals; or transmitting the binary control signals to the plurality of row drivers to control a state of the row of pixel elements of the array and transmitting a select signal that selects the plurality of column drivers to select a column of pixel elements of the array to receive the binary control signals, wherein:

the select signal and the binary control signals are in synchronization with a clock signal of a controller, the plurality of column drivers is each respectively electrically coupled to a column of the array, the plurality of row drivers is each respectively electrically coupled to a row of the array, the look up table memory stores multiple look up tables, and the method further comprises selecting the look up table from the multiple look up tables.

12. The method according to claim 11, further comprising:

temporarily storing the input video data in a frame memory, wherein receiving the input video data comprises receiving, at the controller, the input video data from the frame memory.

13. The method according to claim 11, wherein receiving the input video data comprises receiving the input video data on a frame-by-frame basis, and selecting the look up table comprises selecting a respective look up table to use for each frame from the multiple look up tables.

14. The method according to claim 11, wherein selecting the look up table comprises selecting look up tables to use from the multiple look up tables in a predetermined order.

15. The method according to claim 11, further comprising:

dividing the input video data into a plurality of blocks; and assigning the multiple groups to the plurality of blocks.

16. The method according to claim 15, wherein assigning the multiple groups comprises assigning each of the multiple groups to respective blocks of the plurality of blocks in one of a random order or a predetermined order.

17. The method according to claim 16, wherein each block comprises multiple rows of the array, and the predetermined order specifies that each group of the multiple groups is assigned to a respective row of the multiple rows in a respective block in one of a same order or a different order.

* * * * *